US005548376A

United States Patent [19]

Kikuno

[11] Patent Number: 5,548,376

[45] Date of Patent: Aug. 20, 1996

[54] MANAGING SYSTEM IN IMAGE FORMING APPARATUS

[75] Inventor: Mitsutoyo Kikuno, Tokyo, Japan

[73] Assignee: Ricoh Company Ltd., Tokyo, Japan

[21] Appl. No.: 229,588

[22] Filed: Apr. 19, 1994

[30] Foreign Application Priority Data

May 19, 1993 [JP] Japan ..... 5-141526

[51] Int. Cl.[6] ..... G03G 21/00

[52] U.S. Cl. ..... 355/207; 355/209

[58] Field of Search ..... 355/204, 205, 355/206, 207, 208, 209; 371/16.3, 16.4, 29.1; 379/34, 90, 93, 96, 106

[56] References Cited

U.S. PATENT DOCUMENTS

| | | | |
|---|---|---|---|
| 5,077,582 | 12/1991 | Kravette et al. | 355/206 |
| 5,224,157 | 6/1993 | Yamada et al. | 355/206 X |
| 5,257,069 | 10/1993 | Hirata et al. | 355/206 X |
| 5,305,055 | 4/1994 | Ebner et al. | 355/206 X |
| 5,359,391 | 10/1994 | Kuroyanagi et al. | 355/204 |
| 5,369,471 | 11/1994 | Yamada | 355/206 X |
| 5,404,199 | 4/1995 | Hirata et al. | 355/204 |
| 5,414,494 | 5/1995 | Aikens et al. | 355/206 X |

FOREIGN PATENT DOCUMENTS

| | | |
|---|---|---|
| 59-142559 | 8/1984 | Japan . |
| 60-263162 | 12/1985 | Japan . |
| 4308864 | 10/1992 | Japan . |

*Primary Examiner*—Robert Beatty

*Attorney, Agent, or Firm*—Oblon, Spivak, McClelland, Maier, & Neustadt, P.C.

[57] ABSTRACT

A managing system for image forming apparatuses includes a plurality of image forming apparatuses, a managing device connected to the plurality of the image forming apparatuses through a communication line for managing the plurality of the image forming apparatuses, a timer for measuring an elapsed time since a jam recovery operation in the plurality of the image forming apparatuses, an alarm for automatically outputting an alarm signal to the managing device through the communication line when the elapsed time measured by the timer reaches at an alarm transmitting level, and a level setter for setting a level so as to generate the alarm signal which is outputted from the alarm.

4 Claims, 6 Drawing Sheets

MANAGING SYSTEM IN IMAGE FORMING APPARATUS

BACKGROUND OF THE INVENTION

1. Field of the Invention

The present invention relates to a managing system in an image forming apparatus such as a copier, printer, facsimile transceiver or similar photographic image forming apparatus which electrostatically forms an image on an image carrier.

More particularly, the invention is concerned with a managing system for informing users of jamming of a transfer sheet, and of the need for maintenance or repair, in accordance with predetermined conditions set by the users, with an appropriate recovery procedure depending on an application usage, and based on criteria which is determined by users.

2. Description of the Related Art

A conventional managing system for an image forming apparatus of this kind is already known from Japanese Patent Laid-Open No. 2-259663 which discloses an information collecting system in an image forming apparatus.

In the information collecting system, when the image forming apparatus undergoes a failure which requires maintenance or repair, various kinds of information in regard to the application usage of the image forming apparatus are transmitted to a host computer for managing the system so that a maintenance or repair operation of the image forming apparatus (hereinafter simply referred to as a repair) may be efficiently and correctly performed.

However, in the above-mentioned conventional information collecting system of the image forming apparatus, when the image forming apparatus, such as a copier, has a paper jam or otherwise requires repair, all the information pertaining to the problem is automatically transmitted to the host computer. There arises a drawback that the information collecting system of the image forming apparatus can not cope with the following situation.

In a paper jam or other failure mode of the copier, it is not necessary to transmit information to the host computer to perform the repair immediately after the first occurrence of a jam of the transfer sheet. A simple maintenance operation at the copier to clear the jam is sufficient. A criteria for judging whether transmitting information to the host computer that the repair is to be performed should be based on the frequency of the occurrence of the jam of the transfer sheet. This criteria for judging whether the repair is to be performed is judged differently for different application usages and is determined by users.

At the time of the occurrence of a jam of the transfer sheet, if the jam continues for a long period of time without correction, it should be necessary to inform the host computer to that an immediate repair operation is necessary.

In the above-mentioned case, the need for an immediate repair operation cannot be correctly assessed by the conventional information collecting system of the image forming apparatus. Since the judgement for the necessity of the repair operation cannot be correctly made at the time of the jam of the transfer sheet, it will be difficult to decide whether to perform the repair operation correctly and efficiently. The running time of the image forming apparatus thus increases.

SUMMARY OF THE INVENTION

Accordingly, one object of the present invention is to provide a managing system for an image forming apparatus which can solve the aforementioned conventional drawbacks.

Another object of the present invention is to provide a managing system for an image forming apparatus which can recognize a jam of the transfer sheet at the time of the occurrence of the jam.

Yet another object of the present invention is to provide a managing system for an image forming apparatus which can signal the need for an appropriate maintenance or repair operation so as to improve the rate of running time/operation of the image forming apparatus.

In order to achieve the above-mentioned objects, according to the present invention there is provided a managing system for a plurality of image forming apparatuses including a managing device connected to the plurality of the image forming apparatuses through a communication line for managing the plurality of the image forming apparatuses, a timer for measuring an elapsed time of a jam in the plurality of the image forming apparatuses, an alarm for automatically outputting an alarm signal to the managing device through the communication line when the elapsed time of the jam state measured by the timer reaches an alarm transmitting level, and an adjustable level setter for setting an alarm transmitting level.

Alternatively, the alarm could instead or also output a signal when a jam ratio reaches an alarm transmitting level.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiment of a managing system for an image forming apparatus in accordance with the present invention is explained herein with reference to the accompanying drawings.

Figure 1:
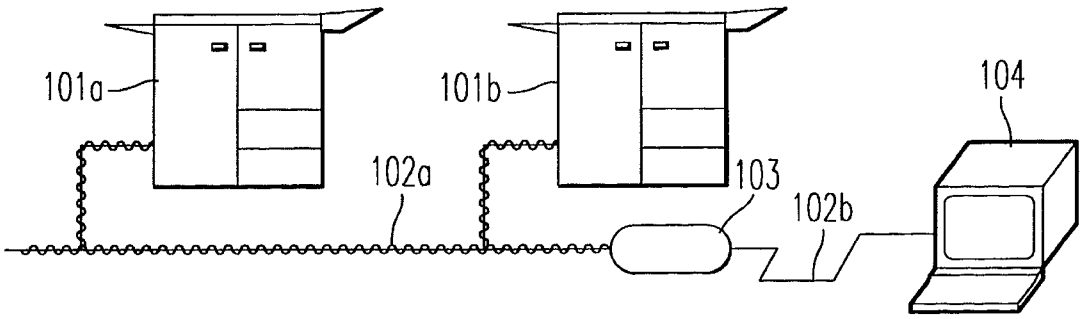
FIG. 1 is a schematic illustration for explaining a managing system for an image forming apparatus in accordance with the present invention.

FIG. 1 is a schematic illustration for explaining an arrangement of a managing system for an image forming apparatus in accordance with the present invention.

Referring to FIG. 1, a plurality of copiers 101*a*, 101*b* are connected to a modem device 103 via an internal communication line 102*a*. The modem device 103 is connected to a host main computer located at a long distance from the copiers 101*a*, 101*b* via a public communication line 102*b*. The host main computer is used as a managing device 104.

In this managing system for the image forming apparatus such as copiers 101*a*, 101*b*, both copiers 101*a*, 101*b* are connected to the managing device 104. Managing information for maintenance or repair operations can be transmitted and received between the copiers 101*a*, 101*b* and the managing device 104.

In this embodiment of the managing system for the image forming apparatus, only two copiers are connected to the managing device 104 for the sake of simplicity. The number of copiers can, of course, be greater.

Figure 2:
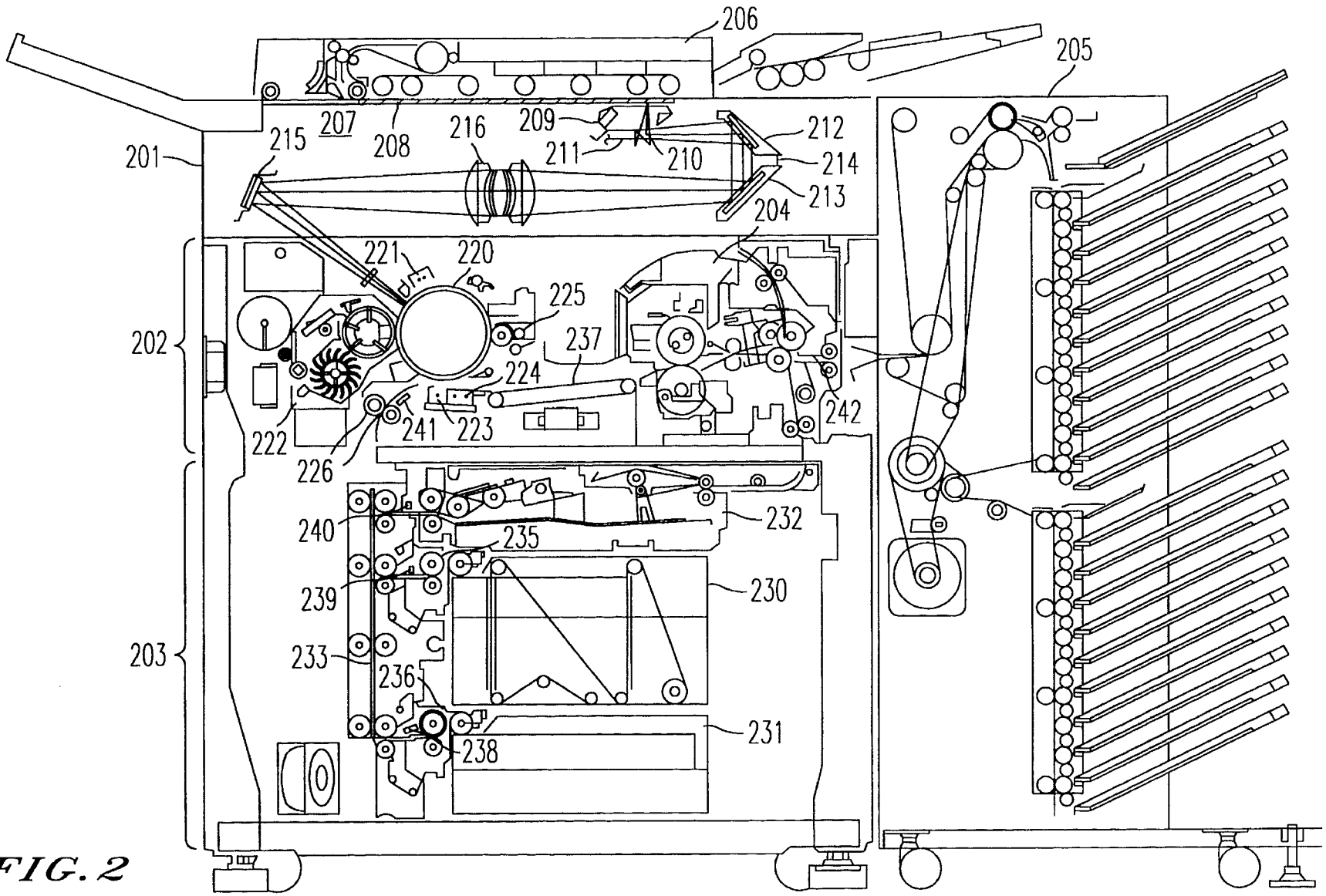
FIG. 2 is a sectional view of one embodiment of a copier in accordance with the present invention.

FIG. 2 is a schematic illustration for explaining the construction of the copier 101*a* (or 101*b*). Referring to FIG. 2, the main components of the copier 101*a* are a document reading-out system 201, an image forming system 202, a paper feeding/conveying system 203, a fixing and paper discharging system 204, and a sorting system 205. The sorting system 205 is a device for sorting copied papers, which is installed in the copier 101*a* as an optional device.

Figure 3:
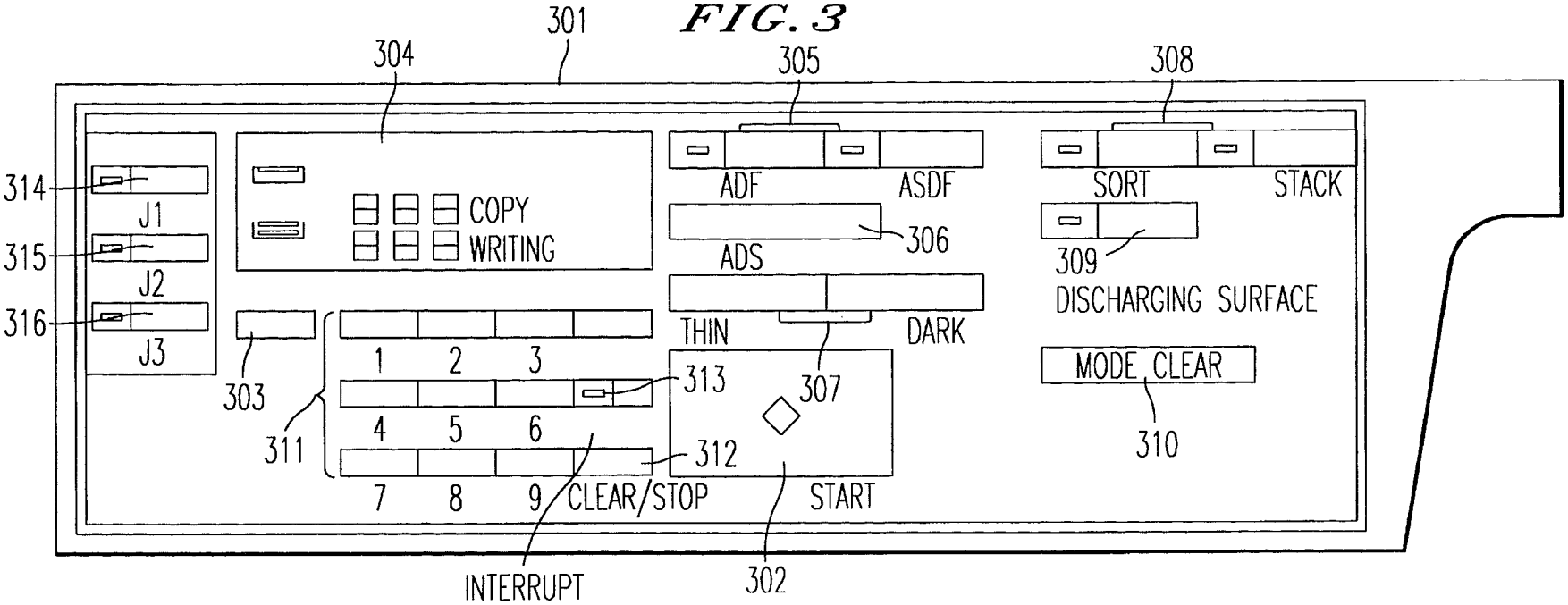
FIG. 3 illustrates a console board of the copier shown in FIG. 2.

Also, the copier 101*a* includes a console board shown in FIG. 3, and a controlling system for controlling electronic devices mounted on the copier 101*a*.

Explanation will now be made briefly to the document reading-out system 201.

The document reading-out system comprises an automatic document feeder 206 and an optical unit 207. The automatic document feeder 206 conveys an original document placed on a setting table to a glass platen 208. The optical unit 207 forms an optical image by illuminating light onto the original document.

The automatic document feeder 206 is pivotally supported relative to the surface of the above-mentioned platen for the original document. The automatic document feeder 206 pivots from an open position to a closed position and vice-versa.

The automatic document feeder 206 includes the setting table for the original document, a plurality of conveying rollers for conveying the original document, and a conveying belt for conveying the original document.

The optical unit 207 includes the glass platen 208, a first scanner 211, a second scanner 213, a fourth mirror 215 and lens 216, all of which are accommodated in a housing. The original document which is conveyed from the setting table is placed on the glass platen 208. The first scanner 211 has an exposure illumination unit 209 and a first mirror 210, which are unitarily mounted on a first carriage. The exposure illumination unit 209 has a fluorescent lamp. The second scanner 213 has a second mirror 212 and a third mirror 213, which are unitarily mounted on a second carriage.

Explanation will be made briefly to the image forming system 202.

The image forming system 202 has a plurality of image forming units for performing an electrophotographic process which is commonly used in a copying process.

The plurality of image forming units comprises a photosensitive unit 220, a primary charging unit 221, a developing unit 222, an image-transferring charging unit 223, a separating charging unit 224, a cleaning unit 225, and a register unit 226.

The photosensitive unit 220 has a photosensitive drum on which an electrostatic latent image is formed.

The primary charging unit 221 has a primary charger which uniformly charges a surface of the photosensitive drum by a means of corona charging.

The developing unit 222 accommodates a toner and performs developing, in which the toner is transferred on the surface of the photosensitive drum in accordance with a developing process.

The image-transferring charging unit 223 has an image-transferring charger which performs a transferring treatment by means of corona discharging.

The separating charging unit 224 has a separating charger which separates the transfer sheet attached on the surface of the photosensitive drum from the photosensitive drum by the means of corona discharging.

The cleaning unit 225 has a fur brush and cleaning blade which remove and collect residual toner on the surface of the photosensitive drum after the image-transferring treatment.

The register unit 226 has a register roller which delivers the transfer sheet so as to accept the electrostatic developed image formed on the photosensitive drum with a predetermined timing.

Explanation will be made briefly of the paper feeding/conveying system 203.

The paper feeding/conveying system 203 is located at the lower part of the copier in this invention.

A plurality of paper feeding trays 230, 231 and a both surface paper feeding unit 232 are provided in the paper feeding/conveying system 203. The paper feeding trays 230, 231 are capable of being drawn forward. The plurality of transferring sheets are stored in the paper feeding trays 230, 231 and a tray of the both surface paper feeding unit 232. A vertically-conveying member 233 is provided in an outlet side of the paper feeding trays 230, 231. The vertically-conveying member 233 is arranged such that the transfer sheet can be delivered from either the paper feeding trays 230, 231 or the tray of the both surface paper feeding unit 232 to the register roller 226.

A paper feeding unit 235, 236 is provided in the respective paper feeding trays 230, 231. The paper feeding units 235, 236 deliver the transfer sheet stored in the paper feeding trays 230, 231 so as to separate the transfer sheets one-by-one. The paper feeding units 235, 236 each have a transfer-sheet pick up roller, a transfer-sheet feeding roller, and a transfer-sheet separating roller.

A conveying belt 237 is provided so as to deliver the transfer sheet to the fixing and paper discharging system 204 after the image-transferring treatment and the transferring-sheet separating treatment.

In the paper feeding/conveying system 203, a first transfer-sheet detecting sensor 238 is disposed in the peripheral location of the outlet of the paper feeding tray 230. A second transfer-sheet detecting sensor 239 is disposed in the peripheral location of the outlet of the paper feeding tray 231. A third transfer-sheet detecting sensor 240 is disposed in the peripheral location of the outlet of the both surface paper feeding unit 232. A fourth transfer-sheet detecting sensor 241 is disposed immediately after the register roller 226. A fifth transfer-sheet detecting sensor 242 is disposed immediately after a paper discharging member of the paper discharging system 204. These transfer-sheet detecting sensors 238, 239, 240, 241, 242 detect the passing of the transfer sheet.

Explanation will now be made to the operation of the copier.

The photosensitive unit 220 is rotatably supported around an axis (not shown) of the photosensitive drum. The photosensitive drum is rotated in the counter-clockwise direction under a command from a microcomputer of the copier.

At the same time, the original document to be copied is delivered to the predetermined position on the glass platen 208 by the automatic document feeder 206. The first scanner 211 performs an exposure scanning for the original document placed on the contact glass 208.

Reflected light rays of the original document are obtained by illumination from the exposure illumination unit 209. The reflected light rays defining a reflected light image are focused on the surface of the photosensitive drum via the first mirror 210, the second mirror 212, the third mirror 213, the lens 216, and the fourth mirror 215.

Prior to above-mentioned operation, the surface of the photosensitive drum is uniformly charged by the primary charger. The electrostatic latent image is formed on the surface of the photosensitive drum. The electrostatic latent image is made of a distribution of electric potential corresponding to the reflected light image.

Light rays radiated from an eraser (not shown) are irradiated to unnecessary portions on the surface of the photosensitive drum so as to compensate the electrostatic latent image to be suitable for either the transfer sheet to be copied or a projecting image.

For obtaining an equal-sized image, the photosensitive drum and the first scanner 214 should be driven at the same speed.

The electrostatic latent image formed on the surface of the photosensitive drum is developed as a toner image by a toner accommodated in the developing unit 222. A developing bias voltage is applied to a developing bias line of the developing unit 222. The amount of toner attached on the photosensitive drum is controlled such that a density of the image can be adjusted.

At almost the same time as the above-mentioned image forming treatment, the operation of the paper feeding/conveying system 203 starts to deliver the transfer sheet. The operator selects a paper feeding process for feeding paper from the paper feeding trays 230, 231, and the tray of the both surface paper feeding unit 232. The paper feeding process is then performed at a predetermined timing.

In the case of feeding paper from the paper feeding tray 230, the transfer sheet is fed from the paper feeding tray 230 upon the operation of the paper feeding unit 235. The transfer sheet is delivered to the register roller 226 via the vertically-conveying member 233. The edge of the transfer sheet is pressed to a nip portion of the register roller 226 which is in a stop mode so as to compensate for skewing of the delivered transfer sheet and so orient the transfer sheet in a correct position, which is called skew compensation.

The transfer sheet is delivered by the restart of the rotation of the register roller 226 with a timing causing the toner image formed on the photosensitive drum to be in correct positional relation thereto.

The transfer sheet is delivered into contact with the photosensitive drum. The toner image formed on the photosensitive drum is then transferred to the transfer sheet by the image-transferring charger.

As the surface of the photosensitive drum is very flat, a sticking force of the transfer sheet to the photosensitive drum is strong. The voltage of the transfer sheet is lowered by the means of corona discharging from the separating charger so that the sticking force of the transfer sheet to the photosensitive drum is weakened.

The transfer sheet is separated from the surface of the photosensitive drum by a separating claw. The transfer sheet which is separated from the photosensitive drum is delivered to the fixing and paper discharging system 204 by the conveying belt 237.

In the fixing and paper discharging system 204, both a fixing roller and a pressurizing roller apply heat and pressure to the transfer sheet. The toner image formed on the transfer sheet is thus fixed. The transfer sheet is discharged either to the sorting system 205 or to the both surface paper feeding unit 232 in the case of a both-surface copying operation.

After the image transferring treatment, residual toner and paper dust from the transfer sheet are attached on the surface of the photosensitive drum. The fur brush of the cleaning unit 225 rotates on the surface of the photosensitive drum. The cleaning blade of the cleaning unit 225 also comes into contact with the surface of the photosensitive drum. Both the fur brush and the cleaning blade remove and collect the residual toner and paper dust attached on the surface of the photosensitive drum.

A surface electric potential of the photosensitive drum is equalized by light rays irradiated from a quenching lamp.

The copier then enters a waiting state for the next operation.

FIG. 3 shows the outer appearance of a console board 301 disposed on the copier 101*a* shown in FIG. 2.

Referring to FIG. 3, the console board 301 is provided with various kinds of function keys 302, 303, 305, 306, 307, 308, 309, 310, 311, 312, 313, 314, 315, and a display member 304. The display member 304 is either a light emitting device or a liquid crystal device.

The function key 302 is used as a start key by which the operator inputs initiation of the copying operation.

The function key 303 is used as a tray selecting key by which the operator selects the paper feeding tray 230, or the paper feeding tray 231, or the tray of the both surface paper feeding unit 232.

The display member 304 includes various kinds of displays.

The function key 305 is used as an ADF (automatic document feeder) selecting key by which the operator may select the mode using the automatic document feeder 206.

The function key 306 is used as an automatic density selecting key for automatically adjusting the density of the image.

The function key 307 is used as a manual density selecting key by which the operator manually selects the density of the image by personal choice.

The function key 308 is used as a sort selecting key by which the operator selects either a stack mode or a sort mode of the sorting system 205.

The function key 309 is used as a discharge selecting key by which the operator selects which surface of the discharged transfer sheet is to face up.

The function key 310 is used as a mode clear key for canceling any input mode which is selected by the operator.

The function keys 311 are comprised of ten keys by which the operator sets the number of transfer sheets to be copied.

The function key 312 is used as a clear/stop key functioning as a stop key to stop a copying operation, and functioning as a correction key to correct the data input through the ten function keys by the operator at a time of non-operation of the copier 101*a*.

The function keys 313 are also used as an interrupt key for stopping a copying operation of the copier 101*a* so as to permit selection and starting of another mode of copying operation.

The function keys 314, 315, 316 are used as application usage keys by which the operator determines the application usage in regard to the managing system.

Figure 4:
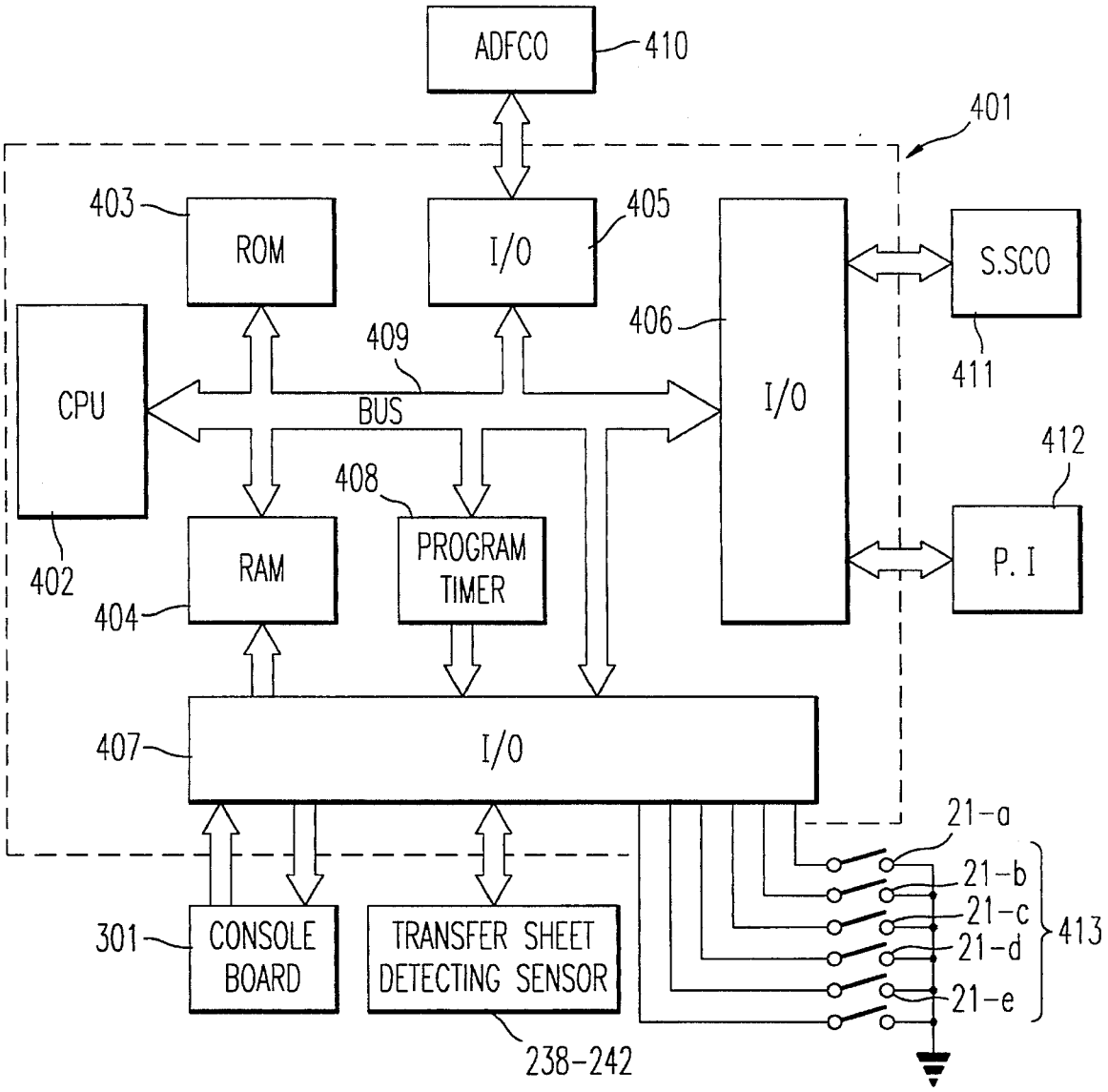
FIG. 4 is a block diagram schematically showing a control system for the image forming apparatus in accordance with the present invention.

FIG. 4 is a control block diagram showing a control system for the image forming apparatus in accordance with the present invention.

Referring to FIG. 4, a main processing board 401 on which a microcomputer is mounted controls the whole operation of the copier 101*a*.

The main processing board 401 has a plurality of main function elements described hereinafter.

The main processing board 401 comprises a CPU (Central Processing Unit) 402, a ROM (Read Only Memory) 403, a RAM (Random Access Memory) 404, a first I/O (Input/Output) terminal 405, a second I/O (Input/Output) terminal 406, a third I/O (Input/Output) terminal 407, a program timer 408 and a bus line 409.

The CPU 402 performs a predetermined operation in accordance with an operation program.

The ROM 403 stores the operation program.

The RAM 404 temporarily stores a data for the operation and a conditional flag.

The I/O terminals 405, 406, 407 are connected to the other units of the copier 101*a* as input/output interfaces.

The program timer 408 has a plurality of timer functions which are capable of being programmed.

The bus line 409 connects the above-mentioned respective elements to each other.

The first I/O (Input/Output) terminal 405 is connected to an ADFCO (Automatic Document Feeder Control unit) which controls the automatic document feeder 206.

The second I/O (Input/Output) terminal 406 is connected to a S.SCO (Sorter and Stapler Control unit) which controls the sorting system 205.

The second I/O (Input/Output) terminal 406 is also connected to a P.I (Protocol Interface) 412 which performs an interface matching operation and a protocol formatting operation for data so as to transmit managing data to the managing device 104. The managing data are signals which are generated at the main processing board 401.

The third I/O (Input/Output) terminal 407 is connected to the console board 301, the transfer sheet detecting sensors 238, 239, 240, 241, 242 and a door switch 413.

The door switch 413 detects an opening/closing state of a front door of the copier 101*a*.

Explanation will now be made of the operation of the control system for the copier 101*a*.

Figure 5:
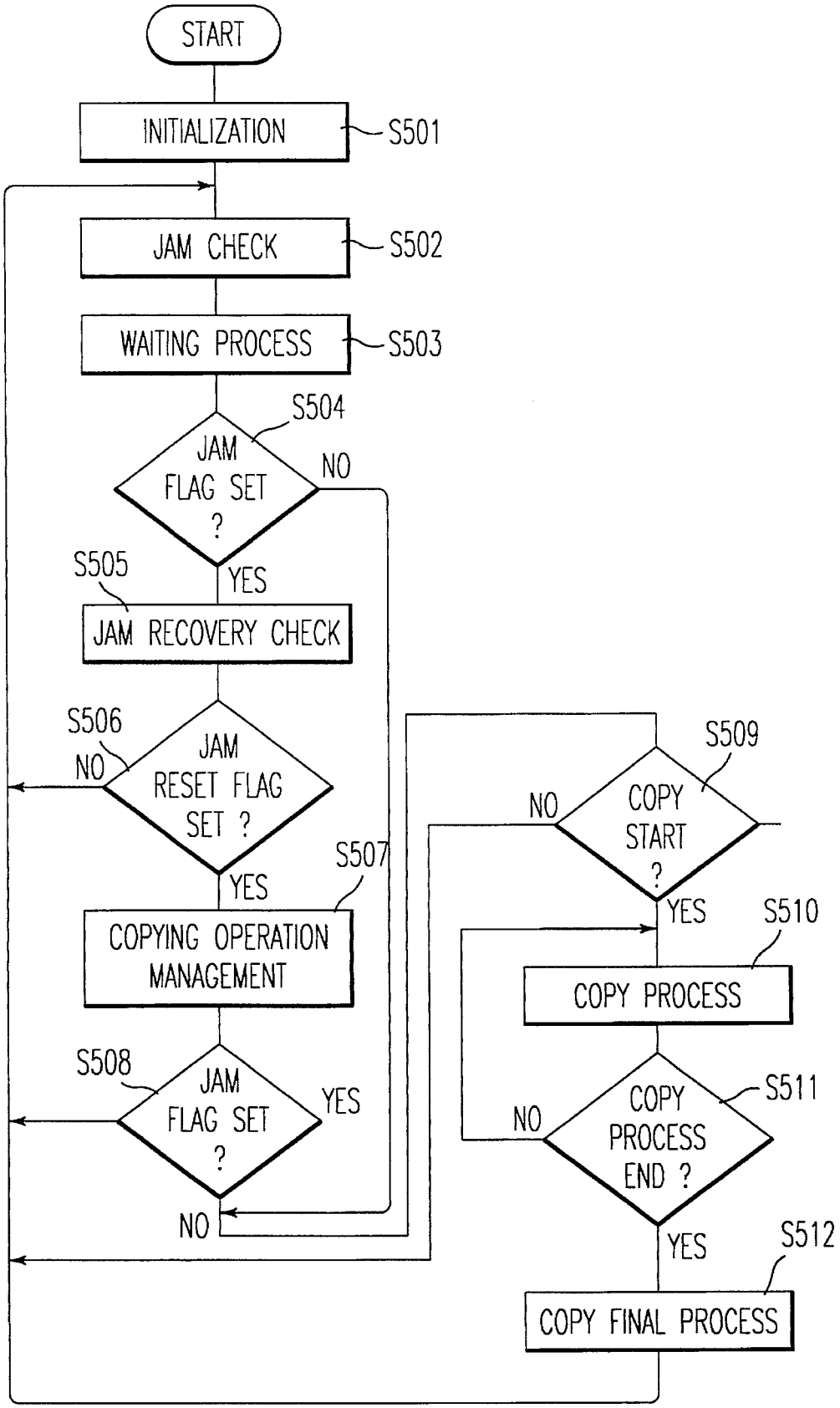
FIG. 5 is a flow chart illustrating the main processing procedure in the microcomputer of the image forming apparatus in accordance with the present invention.

FIG. 5 is the flow chart illustrating the main processing procedure in the microcomputer 402 of the main processing board 401. In the main processing procedure in the microcomputer, a power supply switch (not shown) of the copier 101*a* is turned on. The main processing procedure is executed in accordance with the operation program stored in the ROM 403 of the main processing board 401.

The above-mentioned main processing procedure will be explained in more detail with reference to the flow chart in FIGS. 5, 6, 7 and 8.

In step S501 shown in FIG. 5, an initialization is executed after the operation program is started. The initialization comprises a subroutine in which a control flag for the operation of the control system for the copier 101*a* is reset. Data which is necessary to perform the operation of the control system for the copier 101*a* is thus set.

In step S502, a subroutine (shown in FIG. 7) for checking for a jam of the transferring sheet is executed after the initialization is executed. The subroutine for checking for a jam of the transfer sheet checks for jamming in the copier 101*a*, in which a transfer sheet is jammed in a delivering path for the transfer sheet.

Figure 7:
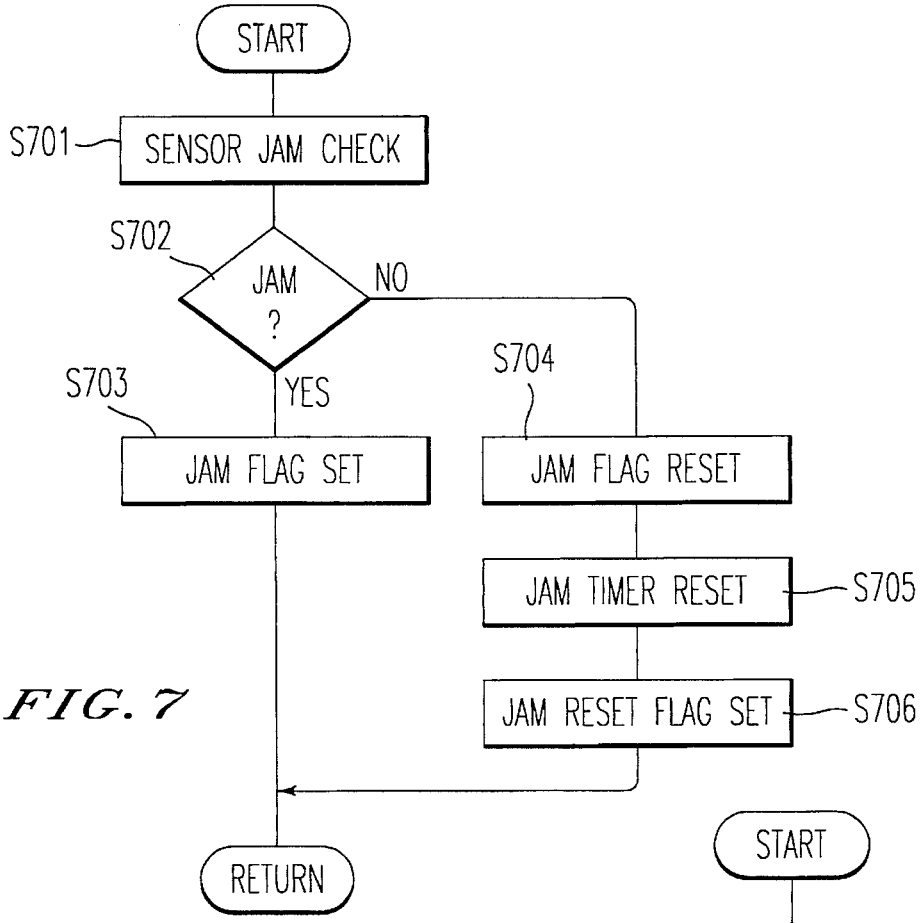
FIG. 7 is a flow chart illustrating a subroutine for checking a jam of a transfer sheet in the microcomputer of the image forming apparatus in accordance with the present invention.

Referring to FIG. 7, step S701 checks a state detected by the transfer sheet detecting sensors 238, 239, 240, 241, 242.

Step S702 judges, based on the output of the sensors 238–242, whether a jam of the transfer sheet has occurred or not.

If step S702 judges that a jam of the transfer sheet is occurring, step S703 sets the jam flag which is one of the control flags.

The subroutine is now completed and control returns to the main processing procedure.

If step S702 judges that the jam of the transfer sheet is not occurring, step S704 resets the jam flag which is one of the control flags.

Step S705 resets the jam timer which measures the time length of the jam of the transfer sheet.

Step S706 resets the jam reset flag.

The subroutine is now completed and control returns to the main processing procedure.

Returning to FIG. 5, in step S503, if a jam of the transfer sheet is detected in the subroutine of FIG. 7, a jam flag which is one of the control flags has been set in step S703. A waiting process is then executed in step S503. In the waiting process, both a processing procedure for the respective units of the copier 101*a* and a display operation of the console board 301 are executed prior to starting the copying operation of the copier 101*a*. For example, if the jam flag is set, the state of the jam is displayed in the console board 301.

In step S504, it is judged whether the jam flag is set or not after the waiting process of step S503.

In step S505, if the step S504 judges that the jam flag is set, the subroutine (shown in FIG. 8) for checking the recovery of the jam of the transfer sheet is executed.

Figure 8:
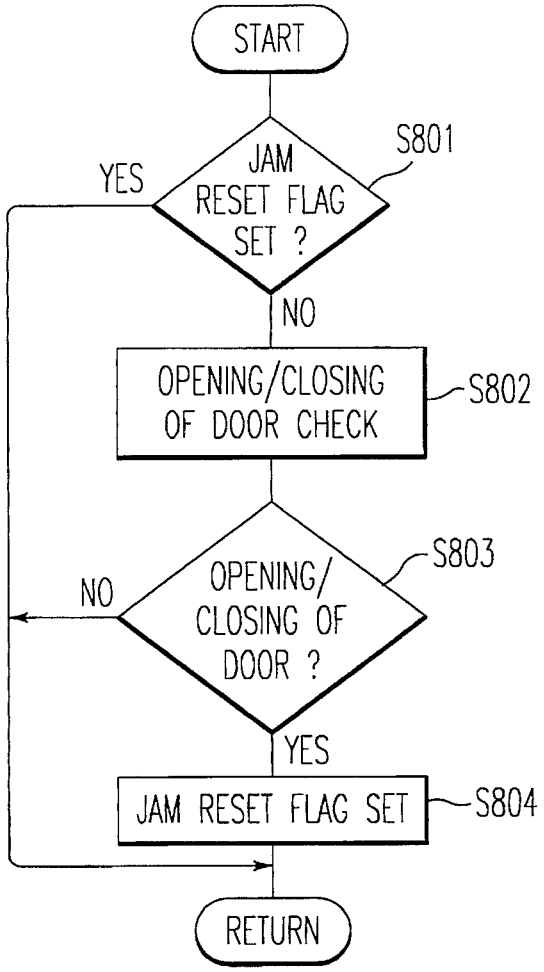
FIG. 8 is a flow chart illustrating a subroutine for checking a recovery of the jam of the transfer sheet in the microcomputer of the image forming apparatus in accordance with the present invention.

Referring to FIG. 8, a step S801 judges whether the jam reset flag is set or not.

If step S801 judges that the jam reset flag is set, the subroutine is completed and returns to the main processing procedure.

If step S801 judges that the jam reset flag is not set, step S802 checks the opening/closing state of the front door of the copier 101*a* in a subroutine for checking whether the front door of the copier 101*a* is opened or closed.

Step S803 judges whether an operation for opening/closing the front door of the copier is executed or not. In other words, the step S803 judges whether the operation of the jam recovery is performed or not.

If step S803 judges that the operation of the jam recovery is not performed, the subroutine is completed and returns to the main processing procedure.

If step S803 judges that the operation of the jam recovery is performed, step S804 sets the jam reset flag which is one of the control flags.

The subroutine is then completed and control returns to the main processing procedure.

Returning to FIG. 5, in step S506 it is judged whether a jam reset flag is set or not after the subroutine of step S505 is executed.

In a step S507, if the step S506 judges that the jam reset flag is set, the subroutine (shown in FIG. 6) for copying operation management is executed. In the subroutine for copying operation management, an operation which is necessary for the copying operation management is performed. If transmitting data which is necessary for the managing device 104 is to be generated, the managing data is output to the managing device 104 through the P.I. (Protocol Interface) 412.

In step S508, it is judged whether the jam flag is set or not after the subroutine for the copying operation management of S507 is executed.

In step S509, it is judged whether the start key as the function key 302 is pushed or not, if the step S508 judges that the jam flag is not set.

In a step S510, a copy process is executed, if step S509 judges that the start key is pushed. In the copy process, a image forming operation, a paper conveying operation, a paper conveying jam operation are executed.

In the image forming operation the respective units perform a copying operation.

In the paper conveying operation the transfer sheet is conveyed in the delivering path.

In the paper conveying jam operation the state of the transferring sheet which is conveyed in the delivering path is checked. If it is detected that the transfer sheet is conveyed in an abnormal way, the jam flag is set. The abnormality can include a jam of the transfer sheet, a non-conveying of the transfer sheet, or a mismatching in the timing of the paper conveying operation.

In step S511, it is judged whether the copy process of step S510 has ended or not.

A completion condition of the copy process is defined by completion of a number of copies which is input from the console board 301, or is defined by a copying interrupt input being received from the console board 301, or is defined by satisfaction of an interrupt condition in which expendable supplies (the toner, the transferring sheet) are consumed.

In a step S512, a subroutine for a copy final process is executed after the step S510 judges that the copy process is completed. The subroutine for the copy final process is defined by a processing procedure for preparing a subsequent copying operation, and includes a processing procedure for performing the initialization of the data for the respective operations.

After the subroutine for the copy final process of step S512 is executed, the main processing procedure returns to the step S502 so as to prepare for the next copying operation.

If the step S504 judges that the jam flag is not set, the main processing procedure goes to step S509 so as to judge whether the start key is pushed or not.

If step S506 judges that the jam reset flag is not set, the main processing procedure returns to step S502 so as to prepare for the next copying operation.

If step S508 judges that the jam flag is set, the main processing procedure returns to the step S502 so as to prepare the next copying operation.

If the step S509 judges that the start key is not set, the main processing procedure returns to step S502 so as to prepare for the next copying operation.

If step S511 judges that the copy process is not ended, the main processing procedure goes back to the copy process of step S510.

Figure 6:
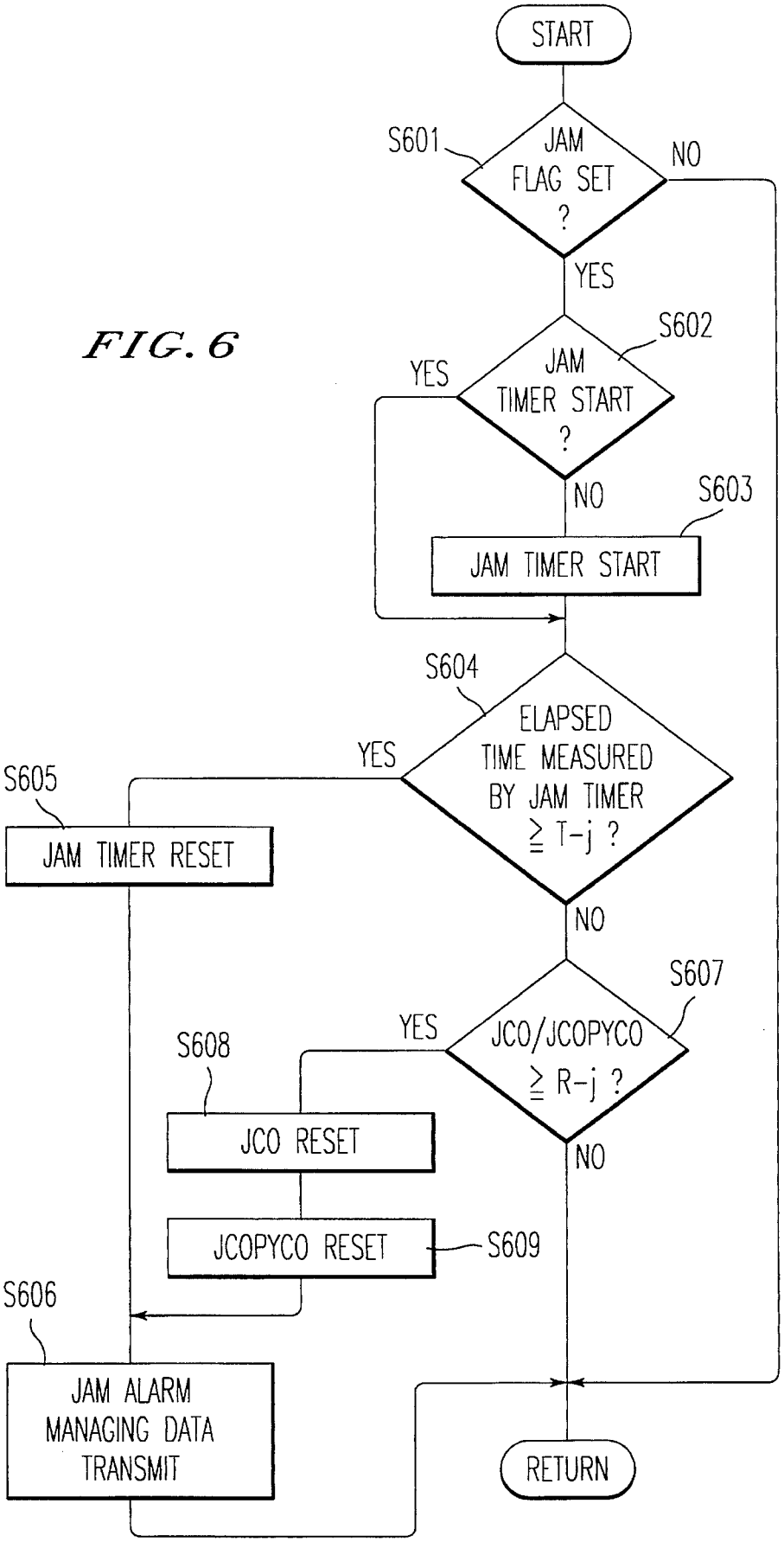
FIG. 6 is a flow chart illustrating a subroutine for copying operation management in the microcomputer of the image forming apparatus in accordance with the present invention.

FIG. 6 is a flow chart illustrating the subroutine for copying operation management, which is the above-mentioned step S507.

Referring to FIG. 6, step S601 judges whether the jam flag is set or not. If step S601 judges that the jam flag is not set, control returns to the main processing procedure shown in FIG. 5.

If step S601 judges that the jam flag is set, step S602 judges whether a jam timer of the program timer 408 is started or not.

If step S602 judges that the jam timer is not started, step S603 starts the jam timer.

If either step S602 judges that the jam timer is started, or step S603 is executed, step S604 judges whether an elapsed time measured by the jam timer is equal to or larger than a jam alarm time T-j or not. For example, the jam alarm time T-j is 30 minutes.

Step S604 judges whether the elapsed time measured by the jam timer is equal to or greater than T-j.

If step S604 judges that the elapsed time measured by the jam timer is equal to or larger than the jam alarm time T-j, step S605 resets the jam timer.

Step S606 performs a subroutine for transmitting jam alarm managing data.

The subroutine is then completed and control returns to the main processing procedure.

If step S604 judges that the elapsed time measured by the jam timer is not equal to or larger than the jam alarm time T-j, step S605 resets the jam timer.

Step S607 judges whether a jam ratio is equal to or larger than a jam alarm ratio R-j or not. The jam ratio is calculated from a jam counter JCO and a jam copy counter JCOPYCO.

Step S607 judges whether JCO/JCOPYCO is equal to or greater than R-j.

If step S607 judges that a jam ratio is equal to or larger than a jam alarm ratio R-j, the subroutine is completed and control returns to the main processing procedure.

If step S607 judges that a jam ratio is not equal to or larger than a jam alarm ratio R-j, step S608 resets the jam counter JCO.

Step S609 resets the jam copy counter JCOPYCO.

The subroutine then goes to step S606. In step S606, the above-mentioned subroutine for transmitting the jam alarm managing data is executed.

Every time a jam of the transferring sheet occurs, the jam counter JCO is counted up in the subroutine of the above-mentioned copy process which is step S510.

Every time a transferring sheet is copied, the jam copy counter JCOPYCO is counted up in a subroutine of the above-mentioned copy process which is the step S510.

The jam alarm time T-j and the jam alarm ratio R-j are set by both the application usage keys for the managing system and the ten keys at the operator's discretion.

An operation for setting both the jam alarm time T-j and the jam alarm ratio R-j is executed in a subroutine of the above-mentioned waiting process which is step S503.

In the above-mentioned subroutine for transmitting the jam alarm managing data which is step S606, both a jam alarm signal and a copying managing information regard to the jam alarm signal are transmitted to the P.I. (Protocol Interface) 412.

If the copier 101*a* remains jammed for a long period of time, the alarm signal is automatically transmitted to the managing device 104.

If the jam of the transferring sheet frequently occurs, the alarm signal is automatically transmitted to the managing device 104.

The above-mentioned managing system for the copiers helps expedite efficient maintenance and repair so as to improve the rate of running time/operation of the copiers.

Various modifications will become possible for those skilled in the art after receiving the teaching of the present disclosure without departing from the scope thereof.

What is claimed is as new and is desired to be secured by Letters Patent of the United States is:

1. A managing system in a plurality of image forming apparatuses, comprising:

a managing device operatively connected to each of the plurality of image forming apparatuses via a communication line;

a jam recovery detector receiving a signal that a jam recovery operation has been performed after a paper jam occurs in one of said plurality of image forming apparatuses;

a timer responsive to a signal of a jam recovery operation in said plurality of image forming apparatuses and measuring an elapsed time since the jam recovery operation;

an alarm receiving a signal from said timer and automatically outputting an alarm signal to said managing device via said communication line when said elapsed time measured by said timer reaches an alarm transmitting level; and an adjustable level setter providing a signal to said alarm for setting the alarm transmitting level.

2. A managing system for image forming apparatuses according to claim 1 wherein said jam recovery detector detects an opening/closing state of a door of each of the plurality of image forming apparatuses.

3. A managing system in an image forming apparatus, comprising:

a managing device operatively connected to the image forming apparatus via a communication line so as to manage the image forming apparatus;

a jam recovery detector receiving a signal that a jam recovery operation has been performed after a paper jam occurs in one of said image forming apparatus;

a timer responsive to a signal of a jam recovery operation in said image forming apparatus and measuring an elapsed time since the jam recovery operation;

an alarm receiving a signal from said timer and automatically outputting an alarm signal to said managing device via said communication line when said elapsed time measured by said timer reaches an alarm transmitting level; and an adjustable level setter providing a signal to said alarm for setting the alarm transmitting level.

4. A managing system for image forming apparatuses according to claim 3 wherein said jam recovery detector detects an opening/closing state of a door of each of the plurality of image forming apparatuses.

* * * * *